US006283311B1

(12) United States Patent
Lee

(10) Patent No.: US 6,283,311 B1
(45) Date of Patent: Sep. 4, 2001

(54) TOOL DISPLAY RACK

(76) Inventor: Jack Lee, No. 53, Nan Shi Keng, Da Nan Village, Mei Shan Hsiang, Jia Yi Hsien (TW)

( * ) Notice: Subject to any disclaimer, the term of this patent is extended or adjusted under 35 U.S.C. 154(b) by 0 days.

(21) Appl. No.: 09/494,445

(22) Filed: Jan. 31, 2000

(51) Int. Cl.[7] ..... A47F 7/00
(52) U.S. Cl. ..... 211/70.6; 206/377
(58) Field of Search ..... 211/70.6, 69; 206/372, 206/376, 378, 349, 477–478, 480–482, 495; 248/27.1, 314, 221.11, 223.31, 220.31, 225.21; D8/71–73, 349, 382, 394, 396; 294/149, 159, 162–163

(56) References Cited

U.S. PATENT DOCUMENTS

| | | | | |
|---|---|---|---|---|
| 539,720 | * | 5/1895 | Bischoff . | |
| 3,807,675 | * | 4/1974 | Seckerson et al. | 248/74 |
| 3,927,765 | * | 12/1975 | Beal | 206/493 |
| 4,295,618 | * | 10/1981 | Morota et al. | 248/73 |
| 4,613,038 | * | 9/1986 | Kirk | 206/216 |
| 5,501,330 | * | 3/1996 | Betts | 206/349 |
| 5,699,901 | * | 12/1997 | Cohen | 206/495 |
| 5,816,401 | * | 10/1998 | Vasudeva et al. | 206/377 |
| 5,855,274 | * | 1/1999 | Piao | 206/373 |
| 5,862,913 | * | 1/1999 | Chou | 206/378 |
| 5,906,350 | * | 5/1999 | Kao | 206/349 |
| 5,967,340 | * | 10/1999 | Kao | 211/70.6 |
| 6,015,124 | * | 1/2000 | Loy | 248/220.31 |
| 6,076,669 | * | 6/2000 | Ling | 206/349 |
| 6,092,656 | * | 7/2000 | Ernst | 206/378 |
| 6,126,004 | * | 10/2000 | Ling | 206/377 |

* cited by examiner

*Primary Examiner*—Daniel P. Stodola
*Assistant Examiner*—Jennifer E. Novosad
(74) *Attorney, Agent, or Firm*—Charles E. Baxley

(57) ABSTRACT

A tool display rack includes a board having two apertures through which two side arms of a retainer extend. A first hook extends from an inside of a first end of each side arm and a retaining plate is connected between the two first hooks. A groove is defined in the inside of a second end of each side arm and a locking member is securely engaged with the two grooves and connected between the two side arms so that the retainer cannot be removed from the two apertures.

5 Claims, 6 Drawing Sheets

TOOL DISPLAY RACK

FIELD OF THE INVENTION

The present invention relates to a tool display rack that secures the tool with the rack and the display rack can still be used as a tool retainer after the retaining plate is cut.

BACKGROUND OF THE INVENTION

A first conventional tool display rack known to applicant is shown in FIG. 5 and includes two holes 10 for hanging the board 11 of the rack on a wall, and a plurality of U-shaped clamping members 12 extending from a side of the board 11. Each clamping member 12 has a retaining space 13 for a tool (not shown) retained therein and a narrow opening 14 communicating with the retaining space 13 so that a shank portion of the tool can be removed from the clamping member 12 via the opening 14. It is obviously that the tool can be easily taken from the rack because that is no locking means to secure the tool to the board 11. A second conventional tool display rack known to applicant is shown in FIG. 6 and includes a hole 10 for hanging the board 11 of the rack on a wall and two apertures 100 for engaging a retainer 16. Two pairs of plates 15 respectively extend from a side of the board 11 and each aperture 100 is located between the two plates 15 corresponding thereto. One of each pair of plates 15 has a protrusion 150 extending laterally inward therefrom. The retainer 16 is an inverted U-shaped member and has a slot 160 defined in each leg of the retainer 16. The two legs will be inserted into the two apertures 100 and the two protrusions 150 are engaged with the two slots 160 in the two legs of the retainer 16. Therefore, a tool can be retained between the board 11 and the retainer 16. Nevertheless, when the rack is bought, the user has to cut the retainer 16 to take the tool and once the retainer 16 is cut, the rack cannot be used anymore.

The present invention intends to provide a tool display rack that can be used to retain a tool after the rack is purchased and the retaining plate is cut.

SUMMARY OF THE INVENTION

In accordance with one aspect of the present invention, there is provided a tool display rack and comprising a board having two apertures and a retainer having two side arms which extend through the two apertures. A retaining plate is connected between two respective first end of the two side arms and a groove is defined in the inside of a second end of each side arm. A locking member is securely engaged with the two grooves and connected between the two side arms.

The object of the present invention is to provide a tool display rack that has a locking member engaged with a retainer so as to prevent the retainer from disengaged from the board.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
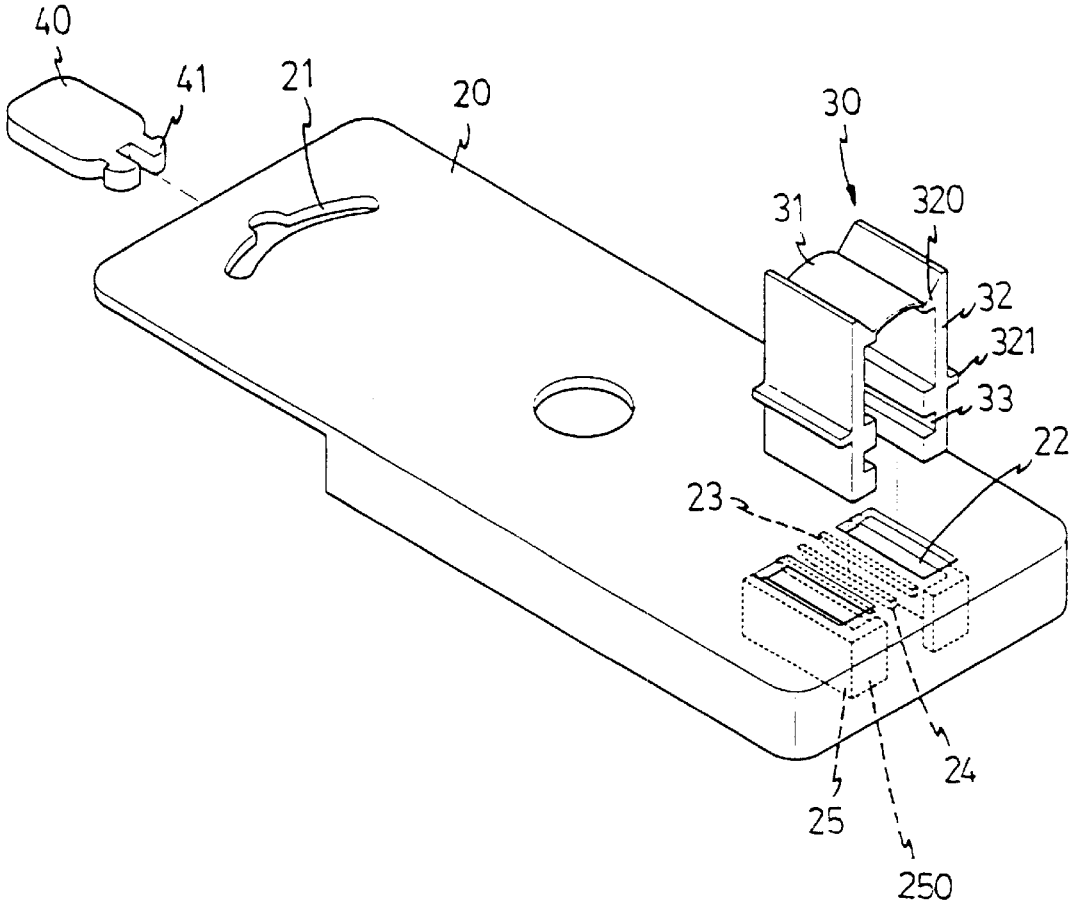
FIG. 1 is an exploded view to show the display rack in accordance with the present invention.
Figure 2:
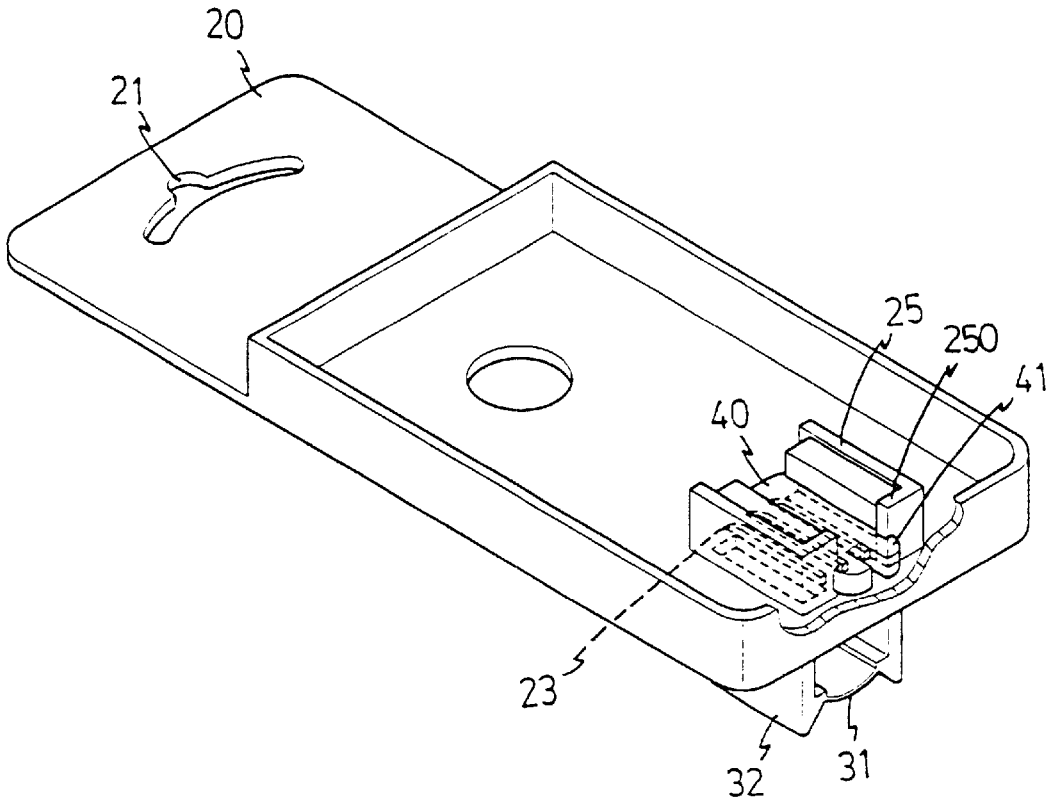
FIG. 2 is a perspective view to show the display rack.
Figure 4:
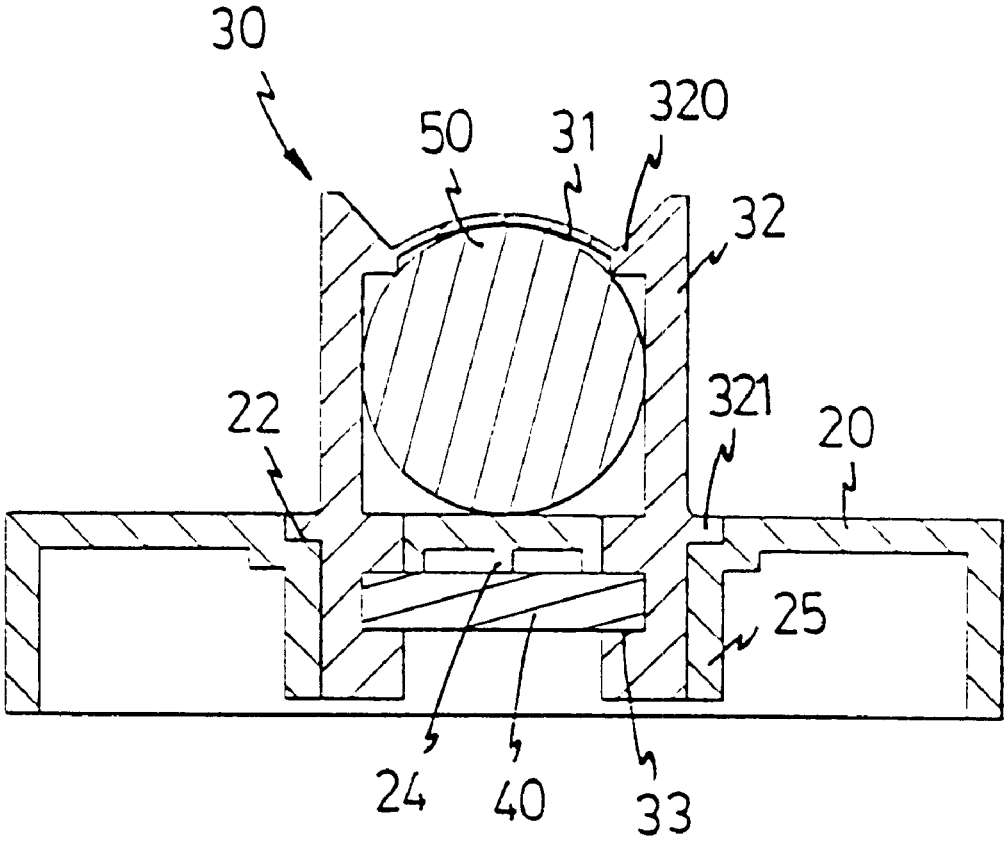
FIG. 4 is a cross sectional view to show a tool is retained by the retainer which is locked by the locking member.
Figure 5:
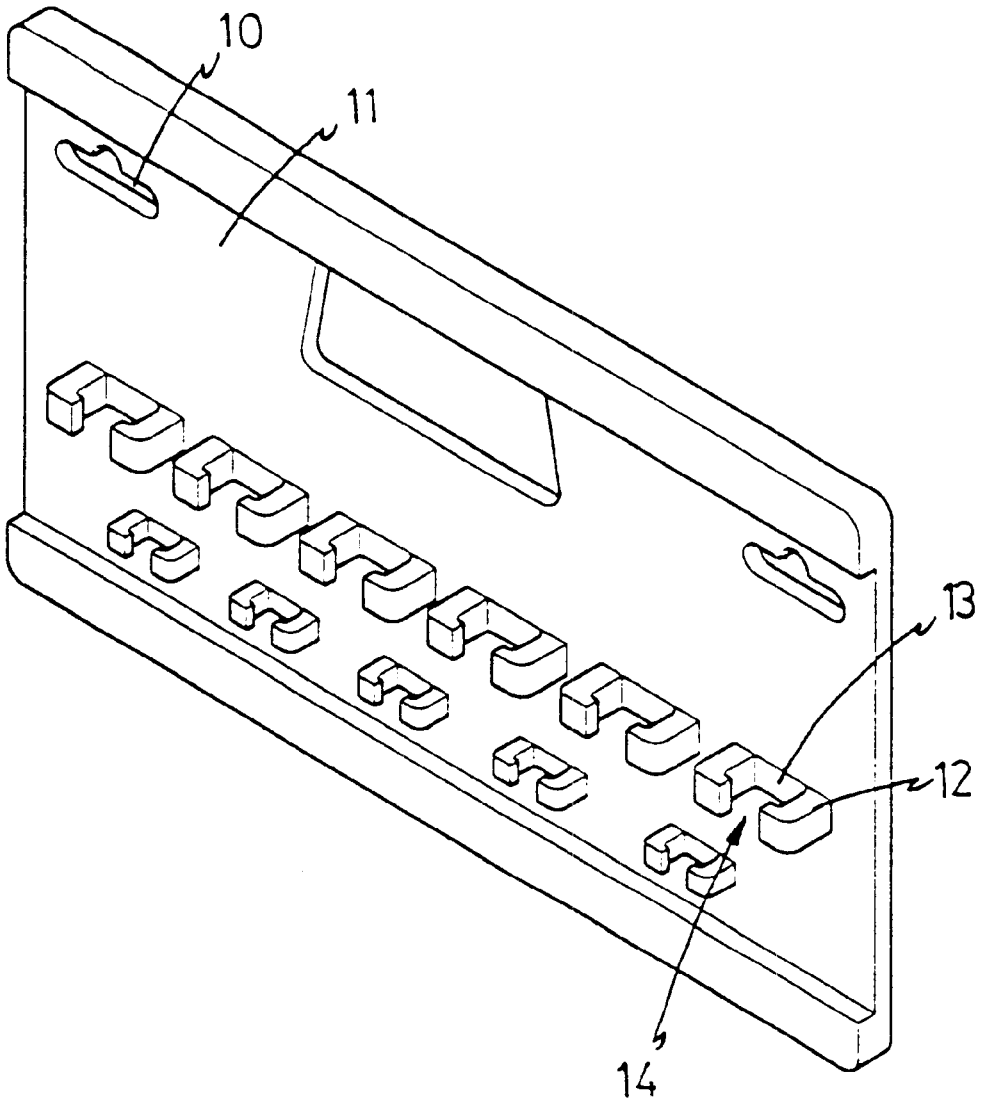
FIG.5 PRIOR ART
FIG. 5 is a perspective view to show a first embodiment of conventional tool display rack.
Figure 6:
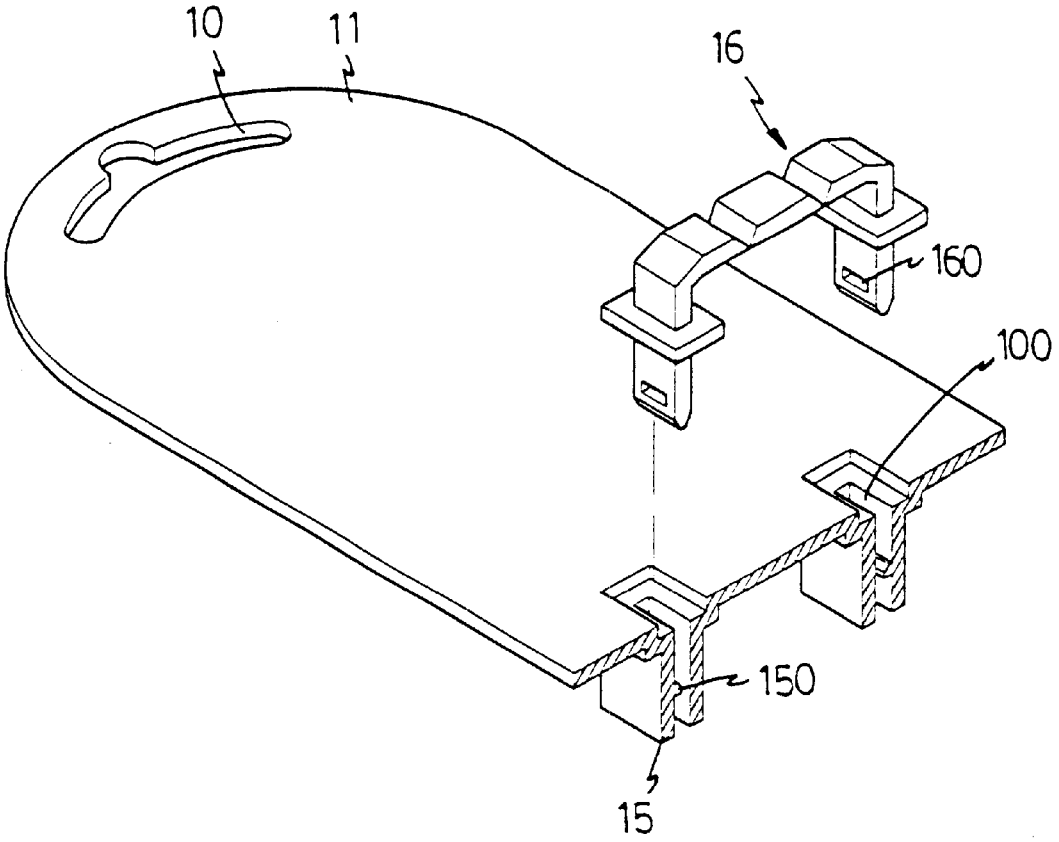
F I G.6 PRIOR ART
FIG. 6 is an exploded view to show a second embodiment of conventional tool display rack.

Referring to FIGS. 1, 2 and 4, the tool display rack in accordance with the present invention comprises a board 20 having a hanging slot 21 defined in a first end thereof d two apertures 22 defined in a second end thereof. A retainer 30 has two side arms 32 and a retaining plate 31 is connected between two respective first end of the two side arms 32. A first hook 320 extends from an inside of the first end of each side arm 32 and the retaining plate 31 is connected between two respective first hooks 320 of the two side arms 32. A groove 33 is defined in the inside of a second end of each side arm 32 and a flange 321 extends radially from each side arm 32 so that when the second ends of the two side arms 32 extend through the two apertures 22 of the board 20, the flanges 321 are respectively engaged with the apertures 22.

A plurality of ribs 24 extend from the board 20 and are located between the two apertures 22. Each rib 24 has an inclined surface 23 defined in one of two ends thereof. A locking member 40 is securely engaged with the two grooves 33 and connected between the two side arms 32. When inserting the locking member 40 into the two grooves 33, the locking member 40 slides on the inclined surfaces 23 of the ribs 24 so that the locking member 40 is easily to be engaged between the two grooves 33. The ribs 24 urge the locking member 40 to enhance the positioning of the locking member 40. The locking member 40 has two second hooks 41 extending longitudinally from one of two ends thereof.

Two guide plates 25 extend from the board 20 and the two guide plates 25 are respectively located beside the two apertures 22 so that two sides of the locking member 40 contact the two guide plates 25. An end piece 250 extends inward from one of two ends of each guide plate 25 and the two second hooks 41 are engaged with the two end pieces 250 after the two second hooks 41 pass over the two grooves 33.

Therefore, as shown in FIG. 4, a tool 50 can be seen and retained in the retainer 30 and the tool 50 will not be taken away except the retaining plate 31 is cut.

Figure 3:
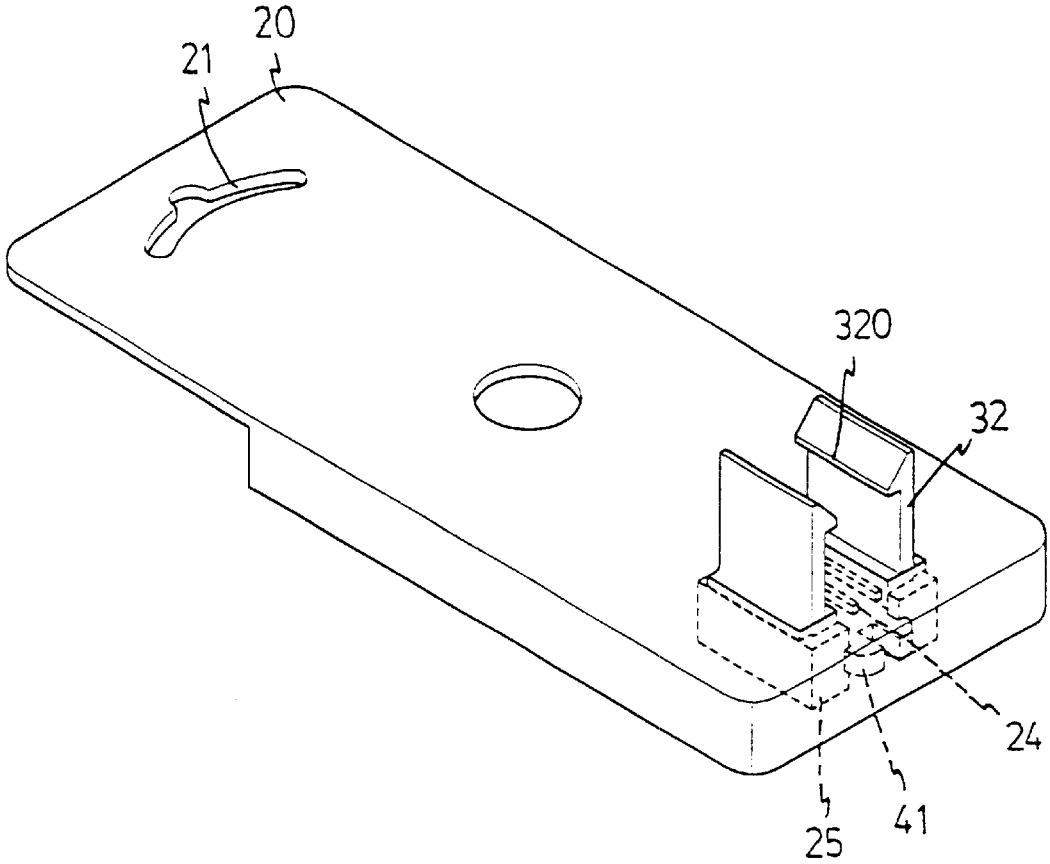
FIG. 3 is a perspective view to show the display rack, wherein the retaining plate is cut.

As shown in FIG. 3, when the tool 50 is purchased, the retaining plate 31 is removed, the two first hooks 320 can be used to clamp the tool 50 so that the rack can still be utilized.

While we have shown and described various embodiments in accordance with the present invention, it should be clear to those skilled in the art that further embodiments may be made without departing from the scope and spirit of the present invention.

What is claimed is:

1. A tool display rack comprising:

a board having two apertures defined therethrough, two guide plates extending from said board and respectively located beside said two apertures, an end piece extending inward from one of two ends of each said guide plate;

a retainer having two side arms and a retaining plate connected between two respective first ends of said two side arms, a groove defined in an inside of a second end of each of said two side arms, said second ends of said two side arms respectively extending through said two apertures of said board, and a locking member securely engaged with said two grooves and connected between said two side arms, said locking member having two second hooks extending longitudinally from one of two ends thereof and said two second hooks engaged with said end pieces.

2. The tool display rack as claimed in claim 1 further comprising a first hook extending from an inside of said first end of each of said two side arms and said retaining plate being connected between two respective said first hooks of said two side arms.

3. The tool display rack as claimed in claim 1, wherein each of said two side arms has a flange extending radially therefrom and said flanges respectively engage said apertures.

4. The tool display rack as claimed in claim 1 further comprising a plurality of ribs extending from said board and located between said two apertures, said ribs contacting said locking member.

5. The tool display rack as claimed in claim 4, wherein each said rib has an inclined surface defined on one of two ends thereof so that said locking member slides on said inclined surfaces of said ribs during movement which engages said two grooves of said side arms.

* * * * *